US005841354A

United States Patent [19]

Bae et al.

[11] Patent Number: 5,841,354

[45] Date of Patent: Nov. 24, 1998

[54] POSITION-SENSING WAKING SYSTEM AND METHOD

[76] Inventors: Tae Hong Bae; Sang Yun Bae; Sang Il Bae, all of 6898 Old Annapolis Rd., Linthicum, Md. 21090

[21] Appl. No.: 807,150

[22] Filed: Feb. 27, 1997

[51] Int. Cl.[6] ..... G08B 23/00

[52] U.S. Cl. ..... 340/575; 200/564; 340/384.7; 340/576; 340/689; 340/693

[58] Field of Search ..... 340/575, 576, 340/573, 693, 689, 686, 384.7; 200/61.52, 61.47, DIG. 2, DIG. 29, 303, 336, 564; 381/68, 68.6, 69, 69.2, 187

[56] References Cited

U.S. PATENT DOCUMENTS

| | | | |
|---|---|---|---|
| 3,045,225 | 7/1962 | Baldwin | 340/575 |
| 3,549,828 | 12/1970 | Lang | 381/69 |
| 4,354,179 | 10/1982 | Fourcade | 340/575 |
| 4,550,227 | 10/1985 | Topholm | 381/69 X |
| 4,644,330 | 2/1987 | Dowling | 340/575 |
| 4,672,672 | 6/1987 | Eggert et al. | 381/69 |
| 5,555,667 | 9/1996 | Bae et al. | 43/17 |

FOREIGN PATENT DOCUMENTS

| | | | |
|---|---|---|---|
| 713855 | 9/1966 | Italy | 340/575 |

OTHER PUBLICATIONS

Brochure 1, Sleeper Beeper II, Sleep Warning Device, pp. 1–2.

Pamphlet 1, Sleeper Beeper II, Sleep Warning Device, pp. 1–2.

Gordon, "Transistorized Driver Alarm", *Popular Electronics,* vol. 12, No. 3, pp. 98–99, Mar. 1960.

*Primary Examiner*—Thomas J. Mullen, Jr.

[57] ABSTRACT

A position-sensing waking system and method includes an ear plug for slidably inserting into an ear of a person, a housing rotatably connected with the ear plug, an alarm mechanism for generating an alarm sound, a detection switch disposed inside the housing, a control circuit for controlling the position-sensing waking system, and a battery for supplying power to the position-sensing waking system, the housing containing the alarm system, the system switch, the detection switch, the control circuit and the battery, wherein the detection switch is activated according to a movement of the ear to generate the alarm sound by the alarm mechanism.

20 Claims, 2 Drawing Sheets

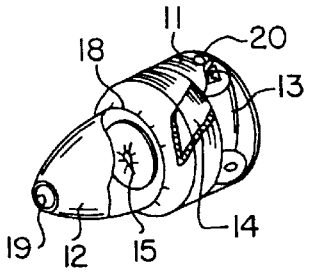
FIG. 1
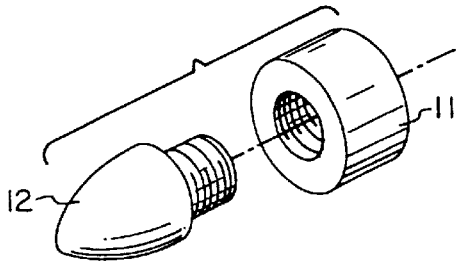
FIG. 1A
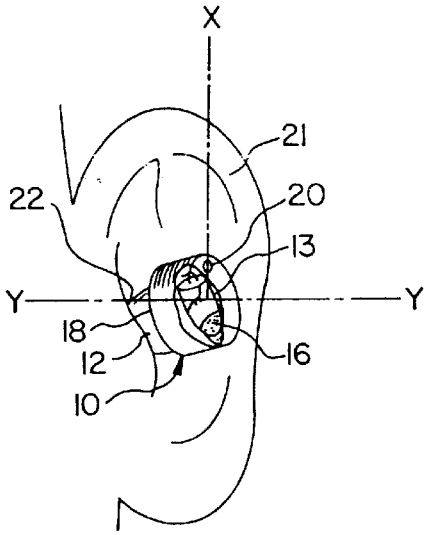
FIG. 2
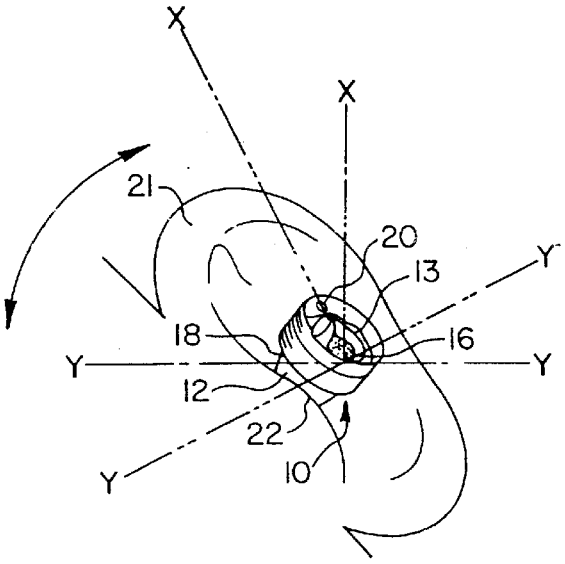
FIG. 3
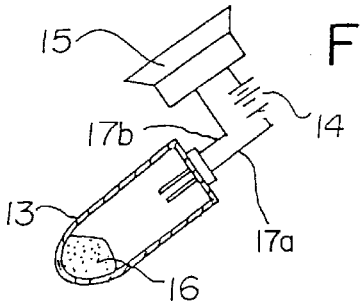
FIG. 4
FIG. 5
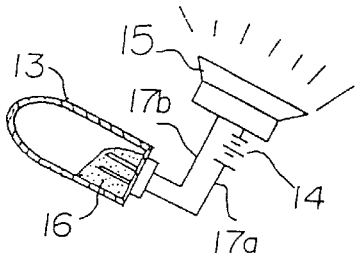

POSITION-SENSING WAKING SYSTEM AND METHOD

BACKGROUND OF THE INVENTION

1. Field of the Invention

The present invention relates to a position-sensing waking system and method and, more particularly, to an improved waking alarm system attachably and detachably insertable into the ear of a user for generating an alarm sound when the user begins to fall asleep.

2. Description of Related Art

Various types of waking devices for a sleepy driver, a sleepy student preparing for an examination, and the like, are known in the art. However, these conventional waking devices have not been effective in waking a sleepy person immediately or waking the person without startling the person. Further, such conventional waking devices are complex in construction and require a relatively large housing which is burdensome to carry. Often, these devices require the user to separately carry a battery for operating them. Therefore the devices become useless if the battery is lost.

SUMMARY OF THE INVENTION

Accordingly, it is an object of the present invention to provide a position-sensing waking system for more effectively and safely waking a person who is beginning to fall asleep, which eliminates the above and other problems encountered with the related waking systems.

Another object of the present invention is to provide a position-sensing waking system including a cone-shaped ear plug attachably and detachably inserted into the ear of a user; a housing attached to the ear plug and containing a sound source for generating an alarm sound and a battery for supplying power to the system; a system switch for selectively controlling the system; a detection switch attached to the housing and being rotatable with respect to the housing to achieve a first position, the detection switch achieving a second position upon a movement of the ear; and a control circuit disposed in the housing, whereby when the position of the user is changed, for example, when he is falling asleep, an alarm sound is generated in response to the detection switch being in the second position and turned on.

A further object of the present invention is to provide a position-sensing alarm system for attachably and detachably inserting into ears or other areas, which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a position-sensing waking system including an ear plug for slidably inserting into an orifice of an ear, a housing rotatably connected with the ear plug, an alarm mechanism for generating an alarm sound, a detection switch disposed inside the housing, a control circuit for controlling the position-sensing waking system, and a battery for supplying power to the position-sensing waking system, the housing containing the alarm system, the system switch, the detection switch, the control circuit and the battery, wherein the detection switch is activated according to a movement of the ear to generate the alarm sound by the alarm mechanism.

Furthermore, the present invention is directed to a position-sensing waking system including an ear plug for inserting into an orifice of an ear; and a housing rotatably connectable with the ear plug, the housing including alarm means for generating an alarm sound, a system switch for controlling the alarm means, a detection switch disposed inside the housing, and a control circuit for controlling the position-sensing waking system, wherein the system switch is turned on by rotating the ear plug into the housing in a first direction until a maximum rotation position is reached.

Moreover, the present invention is directed to a method of waking a person using a position-sensing alarm system, the method comprising the steps of providing an ear plug rotatably connected to a housing, the housing having a sound source for generating an alarm sound, a detection switch, a system switch for controlling the alarm system, a power source, and a control circuit therein; turning on the system switch by rotating the ear plug to a maximum rotation position into the housing; slidably inserting the ear plug into an ear of the person; and generating the alarm sound by activating the detection switch according to a movement of the ear.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1 is a perspective and cut-away view of a position-sensing waking system according to the embodiments of the present invention, wherein FIG. 1A shows one example of a screw mechanism used in the position-sensing waking system;

FIG. 2 is a perspective and cut-away view of a position-sensing waking system inserted into an ear of a person and being at an off-position according to one embodiment of the present invention;

FIG. 3 is a perspective and cut-away view of the position-sensing waking system inserted into an ear of a person and being at an on-position according to the one embodiment of the present invention.

FIG. 4 is a view showing an off-position of a mercury switch used in the position-sensing waking system according to the one embodiment of the present invention;

FIG. 5 is a view showing an on-position of the mercury switch used in the position-sensing waking system according to the one embodiment of the present invention;

DETAILED DESCRIPTION OF THE PREFERRED EMBODIMENTS

Figure 6:
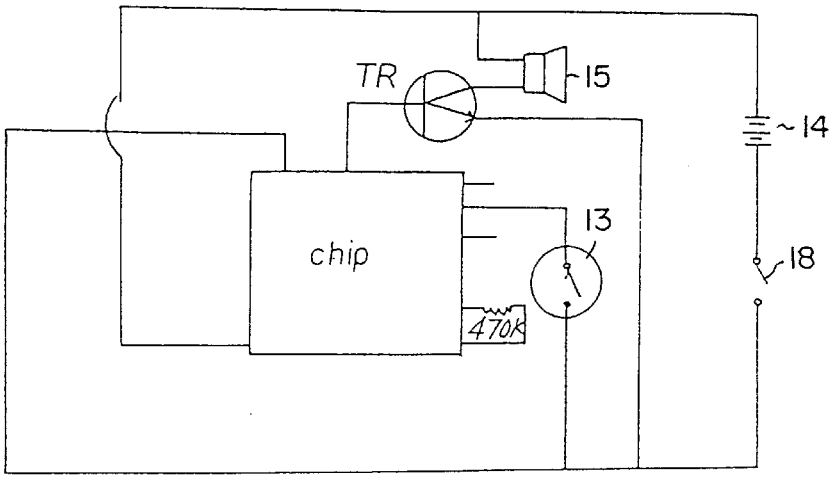
FIG. 6 is a schematic diagram of a circuit used in the position-sensing waking system according to the embodiments of the present invention.
Figure 7:
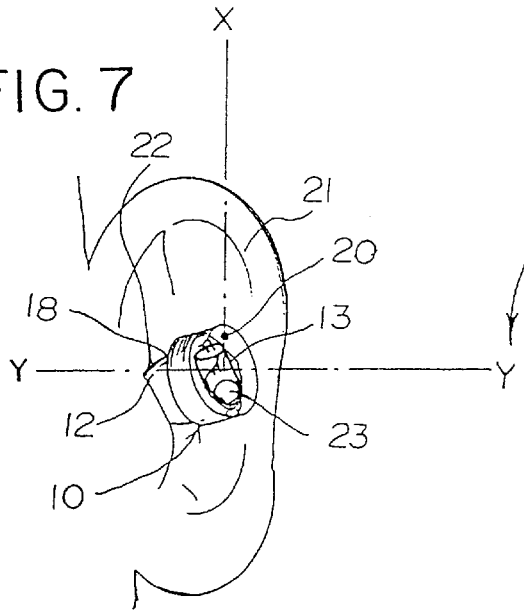
FIG. 7 is a perspective and cut-away view of a position-sensing waking system inserted into an ear of a person and being at an off-position according to another embodiment of the present invention.
Figure 8:
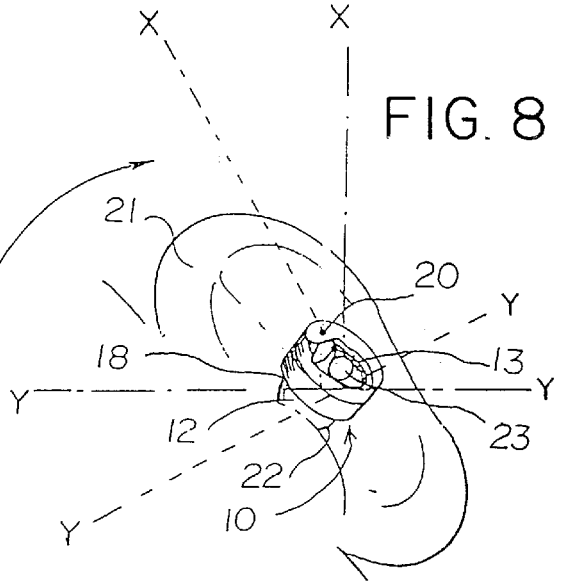
FIG. 8 is a perspective and cut-away view of the position-sensing waking system inserted into an ear of a person and being at an on-position according to the another embodiment of the present invention.

Referring now in detail to the drawings for the purpose of illustrating preferred embodiments of the present invention, a position-sensing waking system 10 according to the present invention is shown in e.g., FIGS. 1–10.

As shown in FIGS. 1–10, the system 10 includes a housing 11 and an ear plug 12 for being adjustably insertable into the orifice 22 of an ear 21. The housing 11 contains batteries 14 for supplying power to the system 10, a speaker 15 for generating an alarm sound through a sound opening 19, a detection switch 13 for detecting the position of the user, a chip for controlling the system 10, and an indicator 20 disposed on the exterior of the housing 11.

The system 10 includes a system switch 18 disposed on the housing 11 which allows the system 10 to be on or off by turning the housing 11 with respect to the ear plug 12. This system switch 18 includes a screw mechanism which is disposed on an outer end portion of the ear plug 12 and an inner portion of the housing 11. An example of such a screw mechanism is shown in FIG. 1A. That is, the ear plug 12 is rotatably connected to the housing 11 by the screw mechanism, just as, e.g., a light bulb is screwed into a light socket for electrically connecting with a power source.

The ear plug 12 has the sound opening 19 through which the alarm sound can be heard, and a gradually tapering conical configuration for slidably inserting into and removing from the orifice 22 of the ear 21.

The system 10 further includes first and second connectors 17*a* and 17*b* disposed within the housing 11 for electrically connecting the rotatable detection switch 13 with the speaker 15.

As shown in FIGS. 4 and 5, the detection switch 13 disposed on the interior of the housing 11 is activated to operate the speaker 15, depending on the position of the ear. The detection switch 13 includes mercury bubbles 16 therein which are moved within the switch 13. That is, the detection switch 13 is a mercury switch according to one embodiment of the present invention. The detection switch 13 is turned off as shown in FIG. 4 when the mercury bubbles 16 do not connect the first and second contacts 17*a* and 17*b*. When the detection switch 13 is turned on as shown in FIG. 5, the mercury bubbles 16 contact both the first and second contacts 17*a* and 17*b* to generate an alarm sound through the speaker 15.

The system switch 18 operates as follows.

When the ear plug 12 is screwed in completely into the housing 11, e.g., in a clockwise direction to the maximum rotation position, the system switch 18 is activated and the system 10 is turned on. When the ear plug 12 is turned, e.g., in a counterclockwise direction away from the maximum rotation position, the system 10 is turned off.

The operation of the waking system 10 is as follows.

First, the user can turn on the waking system 10 by completely turning the ear plug 12 connected to the housing 18 until it cannot be rotated anymore (i.e., it reached the maximum rotation position).

The system 10 as turned on is inserted into the ear of the user. The user can determine whether the housing 11 is correctly positioned by feeling the indicator 20 (e.g., a small dot protrusion) formed on the outer bottom surface of the housing 11. If the indicator 20 is positioned on the top portion of the system 10, the user can assume that the housing 11 is properly positioned and that the waking system 10 is ready to operate. For example, as shown in FIG. 2, when the indicator 20 is located in a vertical "X" axis about a horizontal "Y" axis, the user can be sure that the detection switch 13 is turned off.

As shown in FIGS. 2 and 4, when the detection switch 13 is in the off-position (i.e., when the indicator 20 is positioned on the top portion of the housing 11), no alarm sound is generated. If the user begins to fall asleep and his head begins to nod, the position of the housing 11 is moved which turns on the detection switch 13, as shown in FIGS. 3 and 5. As a result, an alarm sound is immediately generated from the speaker 15 in the user's ear. The alarm will sound continuously as long as the user's head is positioned down. If the user wakes up and lifts up his head, the alarm sound will stop.

Generally, the position-sensing waking system 10 according to the present invention generates an alarm sound when the user's head or ear falls at an angle ranging from 30° to 45°. The detection switch 13 may be positioned differently within the housing 11 to control the degree of head bending needed to sound the alarm. Also, the indicator 20 may be formed at a different location with respect to the position of the detection switch 13 to control the degree of head bending needed to sound the alarm. Similarly, the user can also rotate the housing 11 and ear plug 12 plugged into his ear to control the circumstances in which the alarm sound will be generated. Therefore, the user can easily vary the elements of the system 10 to set the condition for generating an alarm according to his preference, sleeping habit and posture, etc.

The system switch 18 controls the activation of the entire system. When the system switch 18 is in its on-position, an alarm sound is generated if the detection switch 13 is activated. However, when it is unnecessary or ineffective to have the speaker mechanism in operation, for example, during the time when the user is not sleepy, the system switch 18 can be turned off to turn off the waking system 10.

FIG. 6 shows a schematic diagram of a circuitry used in the position-sensing waking system in accordance with the embodiments of the present invention.

As shown in FIG. 6, the chip disposed in one end portion of the housing 11 controls the speaker 15, the detection switch 13, and the system switch 18. The batteries 14 supply 3 volts, for example, to the system 10, and the chip may be, for example, a chip no. 3909 known in the art.

According to another embodiment of the present invention, as shown in FIGS. 7–10, the detection switch 13 includes a metal ball 23 and two support contacts 24. The detection switch 13 having the metal ball 23 operates in the manner similar to the way the detection switch 13 having the mercury bubbles 16 operates.

Figure 9:
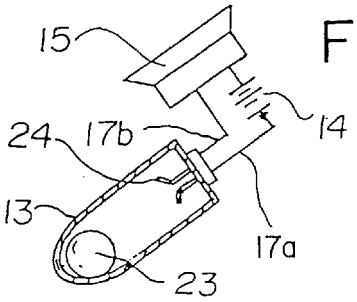
FIG. 9 is a view showing an off-position of a ball switch used in the position-sensing waking system according to the another embodiment of the present invention.
Figure 10:
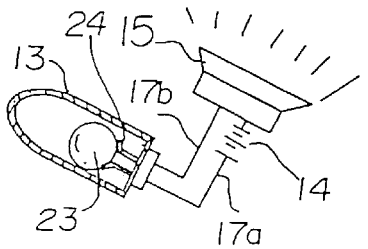
FIG. 10 is a view showing an on-position of the ball switch used in the position-sensing waking system according to the another embodiment of the present invention.

As shown in FIG. 9, the detection switch 13 is turned off when the metal ball 23 does not connect the support contacts 24 which are connected to the first and second contacts 17*a* and 17*b*. When the detection switch 13 is turned on as shown in FIG. 10, the metal ball 23 contacts both support contacts 24 to generate an alarm sound through the speaker 15.

As described hereinabove, the waking system 10 effectively alerts the user when the user is beginning to fall asleep by generating an alarm sound. The system 10 provides the housing 11 and ear plug 12 through which the system 10 can be easily inserted into or removed from the orifice of an ear, and is further equipped with the system switch 18 for selectively operating the alarm system according to the user's preference or for convenience.

Furthermore, because the waking system 10 provides the detection switch 13 which can be adjusted to adapt to the position of the user's head, the user can create a position-sensing waking system which is variably adaptable according to the user's preference and use. In this way, the waking system 10 is applicable and usable by many different users and in many different situations. For example, the present waking system 10 can be used by a sleepy driver, a sleepy student preparing for an examination, a sleepy fisherman, a night worker such as a security man, and the like.

Moreover, the system 10 according to the present invention is effective as a security system against any intruders because movement of the system 10 can activate an alarm sound.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A position-sensing waking system comprising:

an ear plug for inserting into an orifice of an ear; and a housing connected to said ear plug and being rotatable, said housing including, alarm means for generating an alarm sound, a system switch for controlling said alarm means, a detection switch disposed inside said housing, and a control circuit for controlling said position-sensing waking system, wherein said system switch is turned on by rotating said ear plug into said housing in a first direction until a maximum rotation position is reached.

2. The position-sensing waking system of claim 1, wherein said system switch is turned off by rotating said ear plug in a second direction away from the maximum rotation position.

3. The position-sensing waking system of claim 1, wherein said alarm means includes:

a sound source for generating a sound signal, a speaker for amplifying the sound signal to generate the alarm sound, and a power source for supplying power to said sound source and said control circuit, said power source being permanently fixed inside said housing.

4. The position-sensing waking system of claim 1, wherein said ear plug has an opening disposed on a conical end thereof for transmitting the alarm sound.

5. The position-sensing waking system of claim 1, wherein said control circuit includes:

a chip mounted near one end portion of said housing for controlling said alarm means, said detection switch, and said system switch, and connection means for electrically connecting said chip, said detection switch and said alarm means.

6. The position-sensing waking system of claim 1, wherein said detection switch includes either mercury bubbles or a metal ball, and further includes first and second contacts for connecting with said alarm means.

7. The position-sensing waking system of claim 1, wherein said ear plug has a cone shape.

8. The position-sensing waking system of claim 1, wherein said housing includes an indicator for indicating a position of said detection switch.

9. The position-sensing waking system of claim 8, wherein said indicator is a protrusion formed on the bottom outer surface of said housing.

10. The position-sensing waking system of claim 8, wherein said alarm sound is generated when said indicator is positioned at an angle ranging from approximately 30° to approximately 45° with respect to a vertical reference line from a center of the bottom surface of said housing.

11. The position-sensing waking system of claim 1, wherein said system switch includes a screw mechanism formed on an end portion of said ear plug and on an inner portion of said housing.

12. A position-sensing waking system comprising:

an ear plug for slidably inserting into an orifice of an ear;

a housing rotatably connected with said ear plug;

alarm means for generating an alarm sound;

a detection switch disposed inside said housing;

a control circuit for controlling said position-sensing waking system; and a battery fixed to the housing for supplying power to said position-sensing waking system, wherein said housing contains said alarm means, said detection switch, said control circuit and said battery, and wherein said detection switch is activated according to a movement of the ear to generate the alarm sound by said alarm means.

13. The position-sensing waking system of claim 12, further comprising:

a system switch for turning on and off said position-sensing waking system, said system switch including a screw mechanism formed on an end portion of said ear plug and on an inner portion of said housing.

14. The position-sensing waking system of claim 13, wherein said system switch is turned on by rotating said ear plug into said housing until a maximum rotation position is reached.

15. The position-sensing waking system of claim 14, wherein said system switch is turned off by rotating said ear plug away from the maximum rotation position.

16. The position-sensing waking system of claim 12, wherein said housing includes an indicator for indicating a position of the detection switch inside said housing, and the detection switch contains either a metal ball or mercury bubbles.

17. The position-sensing waking system of claim 16, wherein said alarm sound is generated when said indicator is positioned at an angle ranging from approximately 30° to approximately 45° with respect to a vertical reference line from a center of the bottom surface of said housing.

18. A method of waking a person using a position-sensing alarm system, the method comprising the steps of:

providing an ear plug rotatably connected to a housing, the housing having a sound source for generating an alarm sound, a detection switch, a system switch for controlling the alarm system, a power source, and a control circuit therein;

turning on the system switch by rotating said ear plug into said housing until a maximum rotation position is reached;

slidably inserting the ear plug into an orifice of an ear of the person; and generating the alarm sound by activating the detection switch according to a movement of the ear.

19. The method of claim 18, wherein said housing includes an indicator for indicating a position of the detection switch inside the housing.

20. The method of claim 19, wherein the alarm sound is generated when the indicator is positioned at an angle ranging from approximately 30° to approximately 45° with respect to a vertical reference line from a center of the bottom surface of the housing.

* * * * *